US005192600A

United States Patent [19]

Pontrelli et al.

[11] Patent Number: 5,192,600

[45] Date of Patent: Mar. 9, 1993

[54] STITCHBONDED COMFORT FABRIC

[75] Inventors: Gene J. Pontrelli, Wilmington; Dimitri P. Zafiroglu, Greenville, both of Del.

[73] Assignee: E. I. Du Pont de Nemours and Company, Wilmington, Del.

[21] Appl. No.: 634,646

[22] Filed: Dec. 27, 1990

[51] Int. Cl.[5] ..... D04B 23/08

[52] U.S. Cl. ..... 428/102; 428/284; 428/287; 428/288; 428/298; 428/340; 428/300; 428/219; 66/192; 112/402; 112/420

[58] Field of Search ..... 428/284, 287, 288, 340, 428/298, 300, 219, 102; 66/192; 112/402, 420

[56] References Cited

U.S. PATENT DOCUMENTS

| | | | |
|---|---|---|---|
| 4,194,370 | 3/1979 | Boulton | 428/284 |
| 4,350,727 | 9/1982 | Wald et al. | 428/284 |
| 4,426,414 | 1/1984 | Wilkerson | 428/294 |
| 4,773,238 | 9/1988 | Zafiroglu | 66/192 |
| 4,858,547 | 8/1989 | Sternlieb | 428/294 |
| 4,876,128 | 10/1989 | Zafiroglu | 428/102 |
| 4,891,957 | 1/1990 | Strack et al. | 428/284 |
| 4,897,297 | 1/1990 | Zafiroglu | 428/102 |
| 4,961,982 | 10/1990 | Taylor | 428/41 |

FOREIGN PATENT DOCUMENTS

| | | |
|---|---|---|
| 0296533 | 12/1988 | European Pat. Off. . |
| 0337687 | 10/1989 | European Pat. Off. . |
| 0390579 | 3/1990 | European Pat. Off. . |
| 2209353 | 10/1989 | United Kingdom . |

OTHER PUBLICATIONS

Co—pending U.S. Patent application Ser. No. 07/584,161 filed Sep. 18, 1990.

J. Schwartz, "Gilda Marx's Most Intimate Sell", AMW Magazine (Apr. 1990).

*Primary Examiner*—George F. Lesmes

*Assistant Examiner*—Beverly A. Pawlikowski

[57] ABSTRACT

A stitchbonded comfort fabric is disclosed that is absorbent, durable and quick-drying. The fabric is made up of an absorbent, evaporation-reservoir layer and a nonabsorbent, transport layer. The evaporation-reservoir layer comprises a nonwoven web that is stitched with at least one bulkable stitching yarn. The transport layer weighs at least 10 gms/sq m and can be formed from a network of fibrous stitching yarns that do not significantly absorb water and do not exhibit stitching gaps wider than 3 mm. The resulting fabric has a basis weight of between 20 and 120 gm/sq. m, a bulk of at least 10 cc/gm and the capability of absorbing at least 5 times its weight in water. The fabric is useful in intimate apparel, underwear, swimwear, sports shirting, headbands and comfort linings.

15 Claims, 8 Drawing Sheets

STITCHBONDED COMFORT FABRIC

FIELD OF THE INVENTION

The present invention concerns stitchbonded comfort fabrics that are formed by using one or more layers of a fibrous, nonwoven web and stitching the layers with yarns in such a manner that a bulky and absorbent fabric is produced. In particular, the invention relates to a dual-layered stitchbonded comfort fabric having an absorbent, evaporation-reservoir layer and a nonabsorbent, transport layer. The invention provides for particularly lightweight, durable, quick-absorbing and quick-drying fabrics that have a dry-feeling, comfortable surface compared to presently available dual-layered fabric constructions such as double-knits, laminates, or other stitched nonwovens.

BACKGROUND OF THE INVENTION

Dual-faced knits, wovens and laminates are known in the textile art. Since these fabrics are constructed exclusively with yarns that have rather high density, and since they have to be relatively densely woven or knit to be durable, the resulting fabrics exhibit low drying speeds and have relatively low bulk and absorbency per unit weight. Such traditional fabric structures are only capable of absorbing a few times their weight in water, and have relatively long drying times. In apparel applications where perspiration occurs (e.g., sportswear and underwear), lightweight fabrics that feel dry (i.e., have a "water transport" face against the skin that does not absorb water itself) and absorb and evaporate perspiration quickly are very desirable. Experience in the art has indicated to the applicants that an absorbent fabric capable of holding at least 200 gms of water per square meter, that has a uniform nonabsorbent face of textile fibers (no gaps wider than 3 mm) weighing at least 10 gms/sq m, and that can dry quickly in open air, would act as an effective comfort fabric. However, the lightest constructions of present day dry-feeling knit or woven dual-faced fabrics of this type of construction (e.g., double knits) weigh at least 150–300 gms per sq. m, tend to be uncomfortable because of their sheer weight, and tend to be costly. A durable, absorbent fabric equipped with a "transport" layer that could perform this function at a much lower weight (e.g., a fabric basis weight of 20 to 120 gms per sq. m), and that could hold water at least 5 times its weight, with a bulk of at least 10 cc/gm (for quick-drying), would be very desirable.

Low-density absorbent and nonabsorbent stitchbonded nonwovens are also known. For instance, U.S. Pat. No. 4,773,238 (Zafiroglu) and copending U.S. patent application Ser. No. 07/584,161 filed Sep. 18, 1990, both describe fabrics stitched with elastic or bulkable yarns. These fabrics improve in bulk and absorbency after stitchbonding when the product is allowed to contract, "gather" and "bulk-up". Even higher bulk and absorbency values are achieved in the fabrics disclosed by U.S. Pat. 4,876,128 (Zafiroglu), wherein the degree of bulking is controlled by regulating post-stitching shrinkage. Absorbencies that go as high as 15 times the weight of the fabric are reported. However, in all of the above-identified stitchbonded fabric references, the fabric is constructed with only one layer of a nonwoven substrate, and no attempt is made to construct a dual-layered fabric. In this regard, Examples 3-1 and 3-2 of copending U.S. Ser. No. 07/584,161 are believed to come the closest. These examples disclose a pre-needled substrate containing 55 wt. % woodpulp. This construction results in a fabric that is heavy, relatively dense and slow-drying (bulk 3.3–5.8 cc/gm and absorbency 2.3–3.9 times the weight of the fabric).

Additionally, in the above-identified references, no effort is made to construct a nonabsorbent "transport" layer wherein yarn segments are placed over the absorbent nonwoven substrate. In order to build a 10 gm/sq. m nonabsorbent "transport" layer formed with yarn segments within the limits of U.S. Pat. No. 4,773,238, U.S. Pat. No. 4,876,128 or copending U.S. Ser. No. 07/584,161, with the surface yarn segments leaving stitching gaps no wider than 3 mm, and with at least one bulkable yarn stitched in, the total yarn consumption as stitched would have to be at least 15 gm/sq. m. The weight of yarn per unit area will then grow substantially higher as the fabric is relaxed and gathered.

In U.S. Pat. No. 4,773,238, the yarn content does not exceed 20% of the weight of the fabric. In addition, the fabric is gathered to less than 40% of its original stitched dimensions. With 15 gms/sq. m of yarn, the total fabric weight would be at least $15\times5\times2.5=187$ gm/sq. m which would come close to exceeding the preferred weight limits of the reference, even at the maximum yarn level of 20 wt. %.

U.S. Pat. No. 4,876,128 does disclose bulkable yarns having up to a 20 wt. % yarn content and requires lower levels of shrinkage (a minimum of 10%). The same calculation performed above for U.S. Pat. No. 4,773,238, repeated for the extremes of U.S. Pat. No. 4,876,128, would require a minimum weight of $15\times1.1\times5=83$ gm/sq. m. Although this is a suitable basis weight for purposes of the applicants' present invention, all examples in U.S. Pat. No. 4,876,128 which contain a relatively large amount of yarn (such as samples D, E, and F—10.7 to 11.7 wt. % yarn) have bulks lower than their prescribed limits (e.g., 13.0–14.1 cc/gm vs. 16 cc/gm minimum). Thus, the very high fabric bulks required by U.S. Pat. No. 4,876,128 cannot be obtained with high surface density yarn segments unless relatively heavy starting webs, highly-bulked to counteract yarn weight, are used. The webs disclosed in U.S. Pat. No. 4,876,128 start at a fabric weight of 103 gm/sq. m. With a minimum yarn weight of 15 gm/sq. m added, and the fabric shrunk at least 10%, the total minimum weight of the fabric would exceed 129 gms/sq. m (i.e., $(103+15)\ 1.1=130$ gms/sq. m).

Copending U.S. Ser. No. 07/584,161 recommends yarn percentages under 20 wt. %, but does disclose the use of higher yarn weight percentages. However, in the applicants' experience, in order to construct a comfort fabric, a low-density absorbent substrate (such as a lightly spunlaced staple web containing rayon or cotton or less than 25% woodpulp) must first be selected. The substrate selected must be chosen to be absorbent, have high bulk, low weight, and the stitch pattern would have to be arranged to provide a minimum weight of nonabsorbent yarn of 10 gm/sq. m exposed on one face. The stitch spacings or gaps would have to be no wider than 3 mm, the shrinkage of the fabric would have to be controlled to maximize bulk and avoid fabric densification due to excessive area gathering, and the yarn substrate materials would have to be chosen to allow rapid drying. In this regard, U.S. Ser. No. 07/584,161 does not contain any teaching or examples that approach these conditions. All examples provided in U.S. Ser. No. 07/584,161 are deficient in at least three of the areas the applicants have found necessary to make a comfort fabric. In general these areas of deficiency include:

(1) There is no provision for an absorbent substrate having low-density and quick-drying properties;

(2) When a satisfactory "transport" layer is inadvertently formed with yarn segments, the resulting fabric is overshrunk, overdensified and overweight; and (3) If the fabric is not overshrunk, the "transport" layer is not properly formed because the yarn gaps or spacings are too large (i.e, more than 3 mm).

Moreover, copending U.S. Ser. No. 07/584,161 and U.S. Pat. No. 4,876,128 utilize textured nylon as the wrapping yarn over "Lycra®", or as the main yarn. Nylon, and especially textured nylon, tends to absorb over 10 wt. % water and to hold onto water for extended periods of time. (10 wt. %+regain). This causes the fabric to feel relatively wet when it comes in contact with a wearer's skin.

In summary, none of the above-identified references disclose a dual-layered comfort fabric having a separate, nonabsorbent "transport" layer; and if a transport" layer is inadvertently formed, it is not formed by yarn segments unless conditions are chosen at the extremes. Under these extreme conditions, the fabrics formed do not serve their intended prior art purposes. Moreover, as set forth in the Examples which follow (particularly Examples C and D), the fabrics formed serve the purposes of a comfort fabric very poorly.

Clearly, what is needed is a comfort fabric that does not have the deficiencies inherent in the prior art. It is therefore an object of the invention to provide for a lightweight, bulky comfort fabric which has a separate, nonabsorbent "transport" layer formed by stitched yarn segments or by a nonwoven web. Other objects and advantages of the present invention will become apparent to those skilled in the art upon reference to the attached drawings and to the detailed description of the invention which hereinafter follows.

SUMMARY OF THE INVENTION

In accordance with the invention, a dual-layered comfort fabric is provided which is absorbent, durable, lightweight, quick-drying and very bulky. The fabric comprises an outer, absorbent, evaporation-reservoir layer and an inner, nonabsorbent, transport layer. The absorbent, evaporation-reservoir layer is formed from an absorbent, nonwoven web. The transport layer comprises a fibrous, nonabsorbent surface that can be formed in two ways.

One way to form the nonabsorbent surface is to deploy nonabsorbent stitching yarns in such a manner that the yarn segments appearing on the surface of the transport layer of the fabric form a network that weighs at least 10 gm/sq. m and leaves stitching gaps no wider than 3 mm. The network of yarn segments forming the nonabsorbent, transport layer is made by stitching the yarn segments through the absorbent web in a particular stitching pattern. Stitching is performed such that at least one bulkable stitching yarn is used to form spaced-apart rows of stitches extending along the entire length of the absorbent web. The resulting fabric has a basis weight of from 20 to 120 grams per square meter, preferably 20 to 80 grams per square meter, a bulk of at least 10 cubic centimeters per gram and the capability of absorbing at least 5 times its weight in water.

The other way to form a nonabsorbent surface is to deploy a separate, nonabsorbent, nonwoven web, having a patterned or nonpatterned construction, against the surface of the absorbent, nonwoven web that makes up the evaporation-reservoir layer of the fabric. The nonabsorbent web and the absorbent web are then joined together by at least one bulkable stitching yarn that forms spaced-apart rows of stitches extending along the entire length of the absorbent web. The resulting comfort fabric has a bulk of at least 10 cubic centimeters per gram and the capability of absorbing at least 5 times its weight in water. Preferably, the fabric has a basis weight of between 20 to 120 grams per square meter.

When a garment is made from the comfort fabric and the inner, nonabsorbent, transport layer is placed against the wearer's skin, the fabric feels relatively dry even when the fabric is wet. This occurs because the transport layer transmits moisture away from the wearer's body and towards the absorbent, evaporation-reservoir layer. In particular, the fabric is useful in intimate apparel, underwear, swimwear, sports shirting, headbands and comfort linings.

As used herein, the "outer" fabric layer refers to the layer which is exposed and positioned away from the skin of the wearer when worn as a garment and the "inner" fabric layer refers to the layer which is hidden and positioned against the wearer's skin when worn as a garment.

BRIEF DESCRIPTION OF THE DRAWINGS

The invention will be better understood with reference to the following figures.

DETAILED DESCRIPTION OF THE PREFERRED EMBODIMENTS

Figure 1:
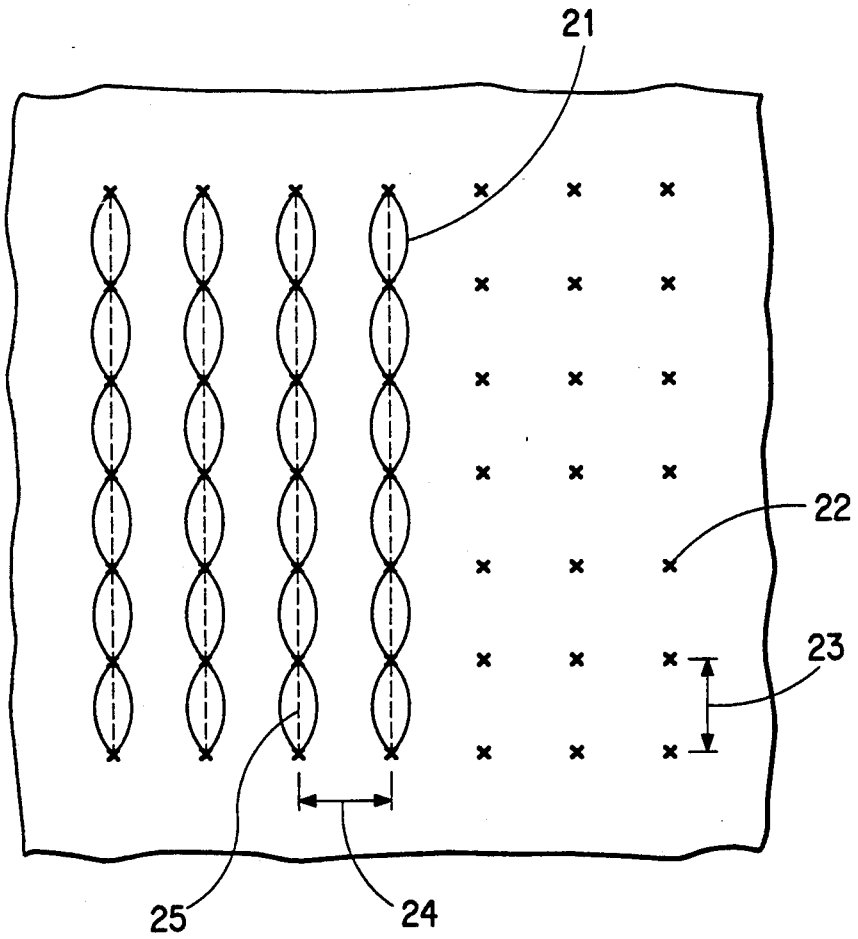
FIG. 1 illustrates a pillar or chain stitched fabric inaccordance with the invention.

The stitching yarns utilized to form the "transport layer" of the invention are preferably constructed with fibers that do not significantly absorb water, and dry easily. For purposes of the invention, it will be understood that the terms "nonabsorbent" and "do not significantly absorb water" mean that the absorbency of the fibers of the transport layer is substantially lower than the absorbency of the fibers contained in the absorbent layer. Excellent non-limiting examples of the fibers of the transport layer include textured polyesters, textured polypropylene or polyethylene, spandex and other polymeric yarns which absorb less than 1 percent of their weight in water. Less preferable fibers include polyaramids, and even less preferable fibers include polyamids (over 10% absorbency resulting in slower drying). It is also preferred that the fibers used to form the "transport layer" be of yarn segments having fine deniers (30–150 denier, less than 10 dpf) to result in better comfort feel.

Alternatively, if the "transport layer" is comprised of a fibrous, nonabsorbent, nonwoven web, the fibers should be of low textile denier, under 10 dpf. Webs suitable as a "transport layer" include low-weight polyester, polypropylene and polyethylene. The webs can be air-laid, carded, spunlaced or spunbonded continuous filaments. It is preferred that the "transport layer" webs not be overly bonded so that they are porous and have good surface aesthetics.

The absorbent, nonwoven webs used to form the "reservoir-evaporation" layer, are preferably high-bulk nonwovens, or bulkable nonwovens such as lightly bonded filament or staple webs. These webs are preferably lightly consolidated. The webs can comprise 100 wt. % absorbent fibers (e.g., rayon, cotton) or other such fibers (e.g., chemically modified polyesters), or blends of cotton/polyester, cotton/polypropylene, rayon/polyester or even woodpulp/polyester. Blended rayon/polyester webs that are preconsolidated (i.e., not highly bonded or hydraulically entangled) make excellent absorbent webs, since they tend to dry quickly and increase in bulk after stitchbonding. The absorbent webs can also consist wholly or partially of continuous fibers (e.g., spunbonded polyester with staple rayon lightly entangled into the spunbonded filaments). However, the fabric should preferably not contain more than 25 wt. % woodpulp since woodpulp forms dense layers that do not dry quickly. It is preferred that if woodpulp is used, that the woodpulp be thoroughly blended with such fibers as polyester, acrylic or polypropylene.

Table I which follows illustrates the usual amount of yarn deployed on each face of a stitched fabric depending upon the stitch pattern used. The data presented shows yarn consumption factors per stitch in units of fabric length if the horizontal and vertical stitch spacings are roughly equal. In other words, this is the length of yarn per length of fabric per stitch. For denser stitches (i.e., larger numbers of stitches per unit length), yarn consumptions can be higher for the front "technical face" (hereinafter the "TECH FACE") of the fabric and substantially higher for the "technical back" (hereinafter the "TECH BACK") of the fabric. The stitches deployed to make a durable, comfort fabric according to the invention include at least one bulkable "stitched-in" yarn. If the transport layer includes "laid-in" yarns, the yarns must be attached to the web with a second, bulkable stitch which provides an anchor point at least every 1.5 mm (17 gauge) to avoid snagging and unraveling. Table I demonstrates that if a "transport layer" weighing at least 10 gm/sq. m is to be formed using only yarn segments, the amount of total yarn deployed must be at least 15 gm/sq. m for the greige, stitched fabric, even if the most favorable conditions are selected to minimize total yarn basis weight. Furthermore, if the fabric is allowed to gather, as provided by the prior art, the total utilized yarn weight increases in proportion to the percentage of gather. Non-limiting inventive examples of yarn stitching patterns that can be used to form a suitable "transport layer" with yarn segments are set forth in Table I, and illustrated in FIGS. 1 through 7. These stitching patterns are well known to those skilled in the textile art.

In brief, FIG. 1 illustrates chain or pillar stitches used to form a yarn segment "transport layer" with stitching gaps smaller than 3 mm. For chain or pillar stitches, the "wale" (the distance between columns of loops lying lengthwise in the fabric) must be smaller than 3 mm, and the "gauge" (the number of wales per inch in a fabric) must be at least 8.5 to satisfy the requirement that the stitching gaps be no wider than 3 mm. (Depending on the fabric stitching pattern chosen, the specified "critical length" will be different in order that the requirement of no gaps being wider than 3 mm will be satisfied.) The minimum length of yarn segments appearing on the front "technical face" ("TECH FACE") per stitch is approximately twice the length of the fabric. For the "technical back" face ("TECH BACK"), the minimum total length is equal to one length of fabric.

For tricot-type stitches (FIGS. 2 and 3), the "course length" (the length of a row of stitches running across a fabric) or the CPI (courses per inch) determines the "critical length" for the "technical back" of the fabric, while the requirements for the front "technical face" remain the same as with a chain or pillar stitch (i.e., a minimum gauge of 8.5). Yarn consumption increases with the number of spaces the yarn is displaced across for every stitch.

For an extended "atlas" stitch (FIG. 4), the spacing requirements and yarn consumptions are identical to that of a simple tricot stitch.

For "laid-in" stitches (FIGS. 5 and 6), the front "technical face" receives no yarn. The "technical back" has the same CPI requirements and yarn consumptions as for "stitched-in" tricot stitches. Laid-in stitches must be affixed with a second stitched-in stitch using bulkable yarn, usually a chain stitch to anchor the laid-in yarns and prevent the yarns from pulling out of the fabric (see FIG. 7). Since the laid-in segments are laid loosely and can continuously pull-out of the structure when snagged, it is necessary to use a tighter gauge (at least 17 gauge and a minimum wale or spacing of 1.5 mm) to catch the laid-in segments at narrow spacings. To provide durability, the yarns used should be no lighter than 30 denier. With this denier, the front-side yarn segment weight at 17 gauge would be at least 5.5 gms. Added to a very carefully constructed minimum 10 gm "technical back" layer, the total minimum yarn weight would be 15.5 gms. Table I illustrates that the absolute minimum construction for an acceptable "transport layer" using nonabsorbent yarn segments will approximately add at least 15 gm/sq. m of yarn weight to the fabric, no matter what stitch pattern is used.

TABLE I

| STITCH TYPE | FIG | NOTATION | (GAUGE APPROXIMATELY EQUAL TO CPI) MINIMUM LENGTH OF YARN/STITCH PER LENGTH OF FABRIC TECH FACE | TECH BACK | TOTAL | MINIMUM TOTAL YARN WITH 10 GM/SQ M "TRANSPORT" LAYER GM/SQ M |
|---|---|---|---|---|---|---|
| A. STITCHED IN | | | | | | |
| "Chain" or "Pillar" | 1 | 1,0/0,1 | 2 | 1 | 3 | 15 |
| "Short Tricot" | 2A | 1,0/1,2 | 2 | 1.5 | 3.5 | 17.5 |
| "Jersey" | 2B | 1,0/2,3 | 2 | 2.5 | 4.5 | 18.0 |
| "Long Float" | 3A | 1,0/3,4 | 2 | 3.2 | 5.2 | 16.3 |
| "Satin" | 3B | 1,0/4,5 | 2 | 4.1 | 6.1 | 14.9 |
| "Atlas" | 4 | 2,3/2,1/ 1,0/1,2 | 2 | 1.5 | 3.5 | 17.5 |
| B. LAID-IN | | | | | | |
| | 5A | 0,0/2,2 | 0 | 1.5 | 1.5 | 15.5* |
| | 5B | 0,0/3,3 | 0 | 2.5 | 2.5 | 15.5* |
| | 6A | 0,0/4,4 | 0 | 3.2 | 3.2 | 15.5* |
| | 6B | 0,0/5,5 | 0 | 4.1 | 4.1 | 15.5* |

Figure 7:
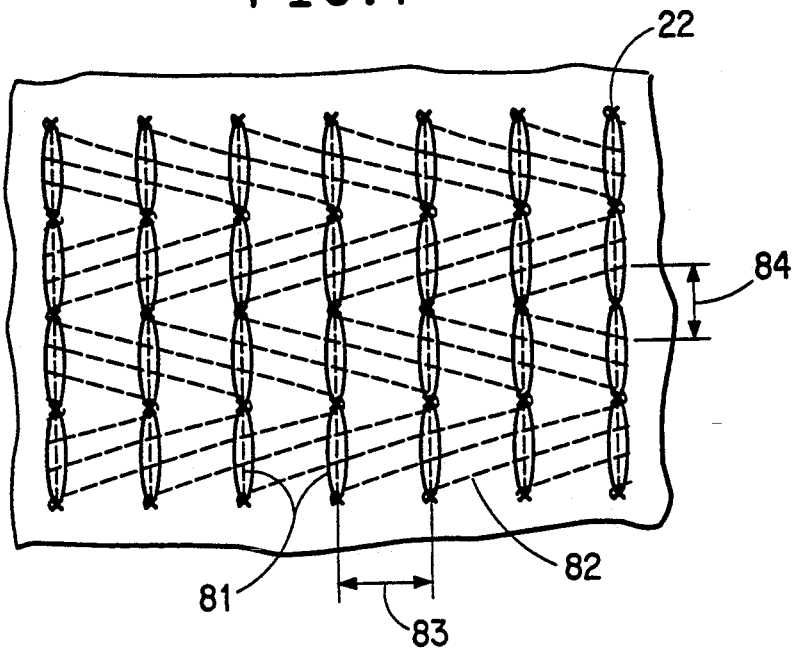
FIG. 7 illustrates a fabric in accordance with the invention combining laid-in and stitched-in yarns.

*Assuming that a chain stitch with a minimum 30 denier yarn at 17 gauge is used to anchor the laid-in stitches (see FIG. 7).

Referring now more precisely to the drawings, wherein like reference numeral sindicate like elements, FIG. 1 is a simple depiction of a pillar or chain stitch designated (1,0/0,1). Yarn segments 21 appear on the technical face or front and are shown as solid lines. With tight yarns, the yarn length is about equal to 2 times the length of fabric per stitch. The needle penetration or yarn insertion points are represented by "X"s 22. Space 23 represents one course. Space 24 represents one wale which, as noted before, is the "critical length" for the front technical face or the technical back face of the fabric. To maintain a 3 mm spacing either on the front technical face or the technical back face, the gauge must be maintained at at least 8.5. Yarn segments 25 are those appearing on the technical back and are shown as dotted lines. For the tight yarn shown, the yarn length is about 1 times the length of fabric per stitch.

Figure 2A:
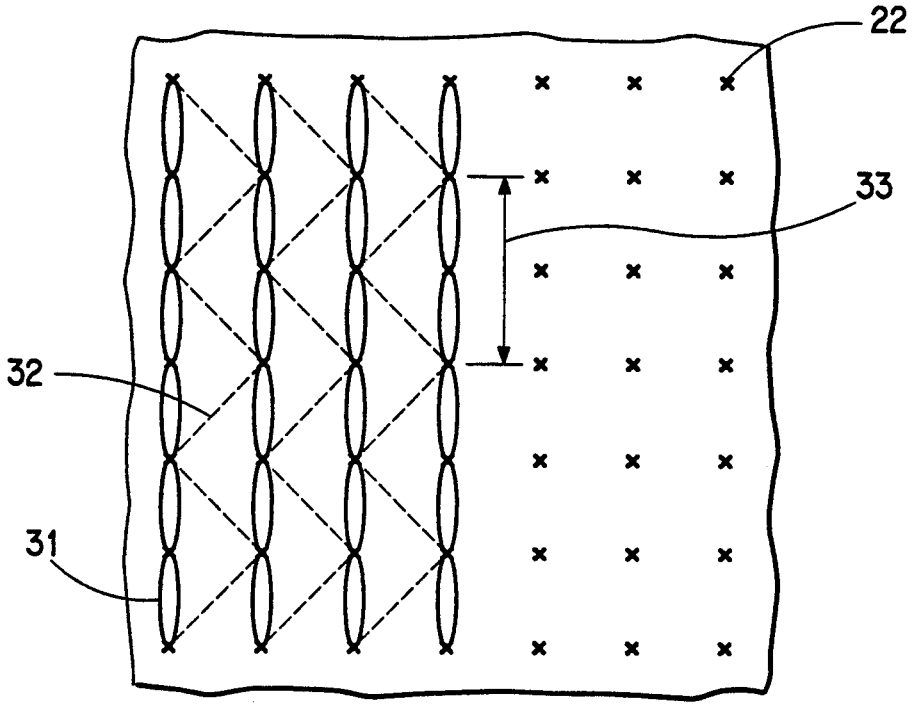
FIG. 2 illustrates a short tricot stitched fabric (A) and a jersey stitched fabric (B), both in accordance with the invention.
Figure 2B:
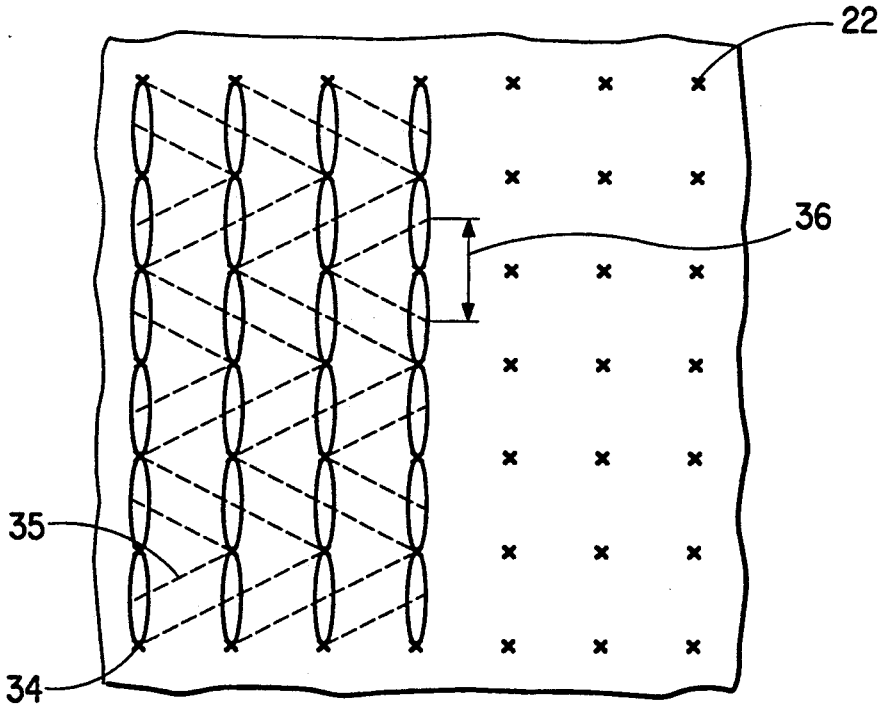

FIG. 2A depicts short tricot stitches designated (1,0/1,2). Front segments 31 have a minimum tight length of about 2 times the length of fabric per stitch. Back segments 32 have a minimum tight length of about 1.5 times the length of fabric per stitch. Assuming the technical back of the fabric is going to be the transport layer, critical length 33 is a maximum of 3 mm. Each course must then be less than 1.5 mm and there must be a minimum CPI of 16. Referring now to FIG. 2B, jersey stitches designated (1,0/2,3) are depicted. Front segments 34 have a minimum yarn length of about 2 times the length of fabric per stitch. Back segments 35 have a minimum yarn length of 2.5 times the length of fabric. Assuming the technical back of the fabric is going to be the transport layer, critical length 36 can be a maximum of 3 mm or have a minimum CPI of 8.5.

Figure 3A:
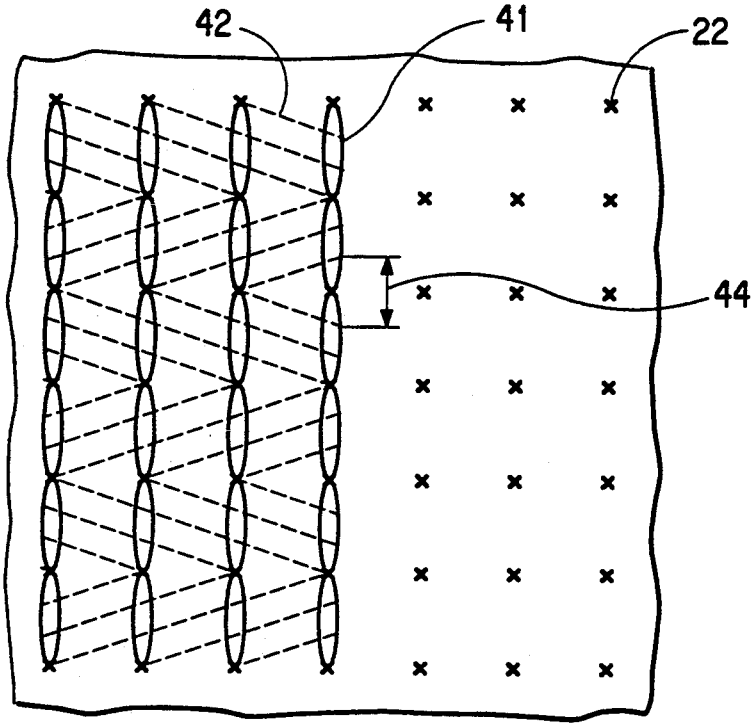
FIG. 3 illustrates a long-float stitched fabric (A) and a satin stitched fabric (B), both in accordance with the invention.
Figure 3B:
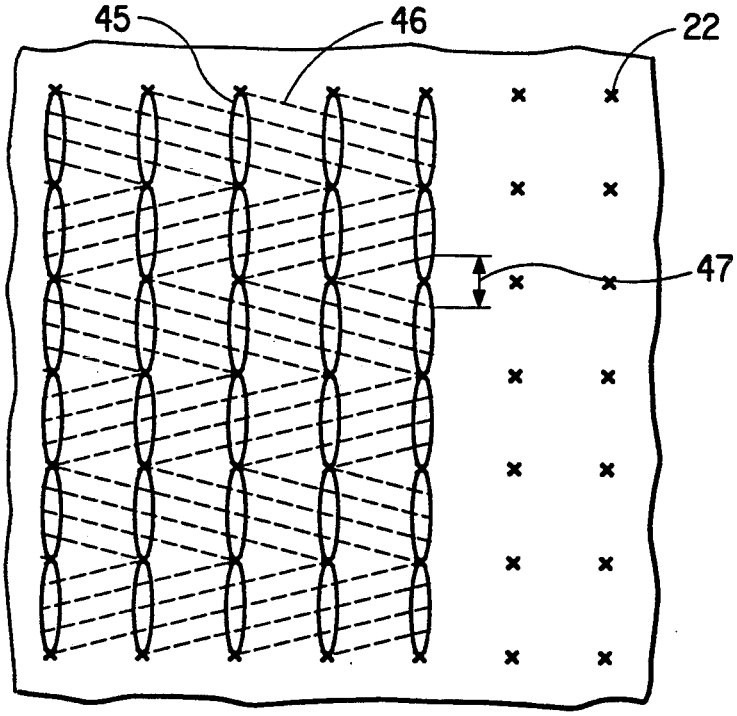

Referring now to FIG. 3, FIG. 3A depicts a long-float stitch (1,0/3,4) wherein the front yarn segments 41 have a minimum yarn length of about 2 times the fabric length per stitch. The back yarn segments 42 have a minimum yarn length of about 3.2 times the fabric length per stitch. Assuming the technical back of the fabric is going to be the transport layer, critical length 44 equals ⅔ of a course which is a maximum of 3 mm or the CPI is a minimum of 5.6. FIG. 3B depicts a satin stitch wherein the front yarn segments 45 have a minimum yarn length of about 2 times the fabric length per stitch and back yarn segments 46 have a minimum yarn length of about 4.1 times the fabric length per stitch. Assuming the technical back of the fabric is going to be the transport layer, critical length 47 is ½ of a course which is a maximum of 3 mm or the CPI is a minimum of 4.2.

Figure 4A:
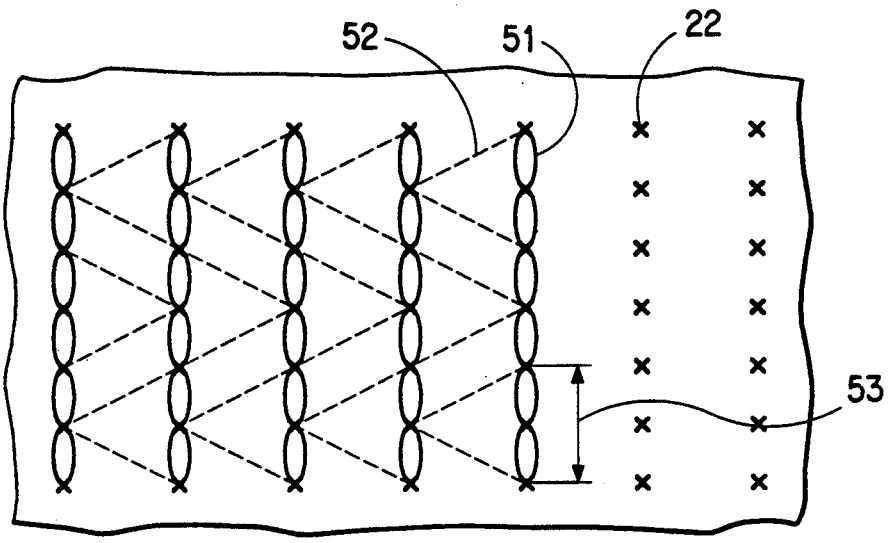
FIG. 4 illustrates two atlas stitched fabrics (A and B), in accordance with the invention.
Figure 4B:
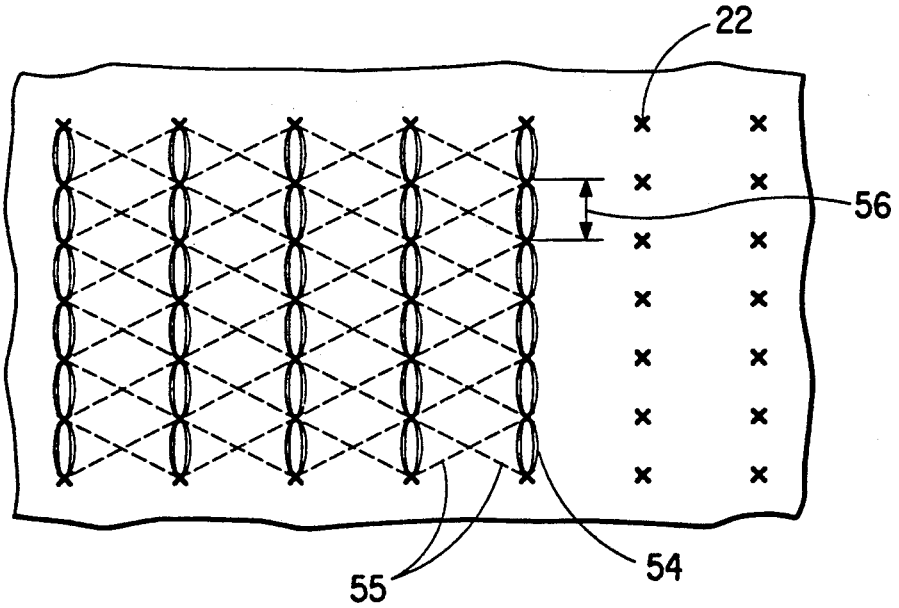

FIGS. 4A and B are depictions of atlas stitches. FIG. 4A shows a single bar atlas stitch designated (2,3/2,1/1,0/1,2) wherein front yarns 51 have a minimum yarn length of about 2 times the fabric length per stitch and back yarns 52 have a minimum yarn length of about 1.5 times the fabric length per stitch. Assuming the technical back of the fabric is going to be the transport layer, critical length 53 is a maximum of 3 mm or the CPI is a minimum of 16. FIG. 4B shows a two-bar atlas stitch designated (2,3/2,1/1,0/1,2) back bar stitch and (1,0/1,2/2,3/1,0) front bar stitch. Front yarn 54 length is about (2+2=4) times the fabric length per stitch combined minimum and the back yarns 55 length is about (1.5+1.5=3) times the fabric length per stitch combined minimum. Assuming the technical back of the fabric is going to be the transport layer, critical length 56 is a maximum of 3 mm or the CPI is a minimum of 8.

Figure 5A:
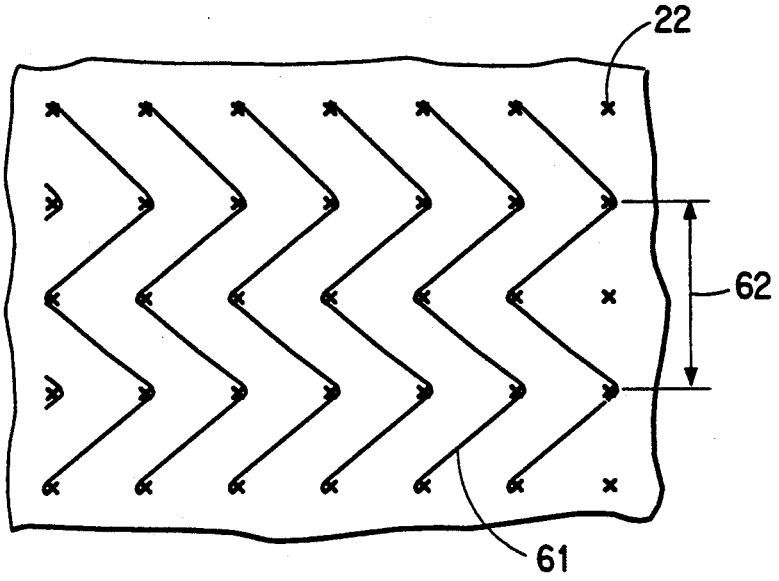
FIG. 5 illustrates a (0,0/2,2) laid-in stitch (A) and a (0,0/3,3) laid-in stitch (B), in accordance with the invention.
Figure 5B:
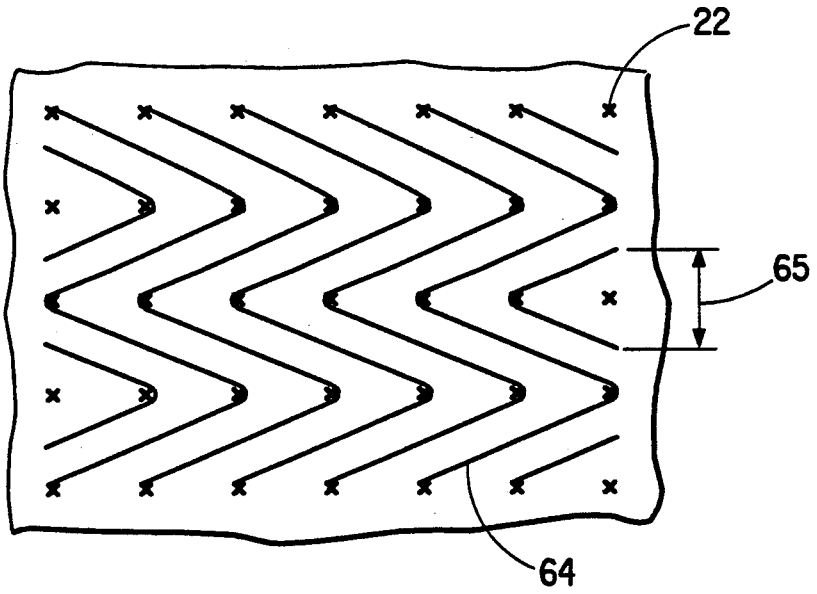

FIGS. 5A and B depict "laid-in" stitches. The laid-in stitches are shown alone for purposes of illustration, and it will be understood that the laid-in stitches will be anchored into the fabric by employing stitched-in stitches. In this regard, FIG. 7 shows the laid-in stitches after they have been anchored by stitched-in stitches. FIG. 5A depicts a (0,0/2,2) stitch pattern wherein 61 is the back yarn (i.e., all yarn on the back) with a minimum yarn length of about 1.5 times the fabric length per stitch. Assuming the technical back of the fabric is going to be the transport layer, critical length 62 is a maximum of 3 mm or the CPI is a minimum of 17. FIG. 5B depicts a (0,0/3,3) stitch pattern wherein 64 is the back yarn (all yarn on back) with a minimum yarn length of about 2.5 times the fabric length per stitch. Assuming the technical back of the fabric is going to be the transport layer, critical length 65 is a maximum of 3 mm or the CPI is a minimum of 8.5.

Figure 6A:
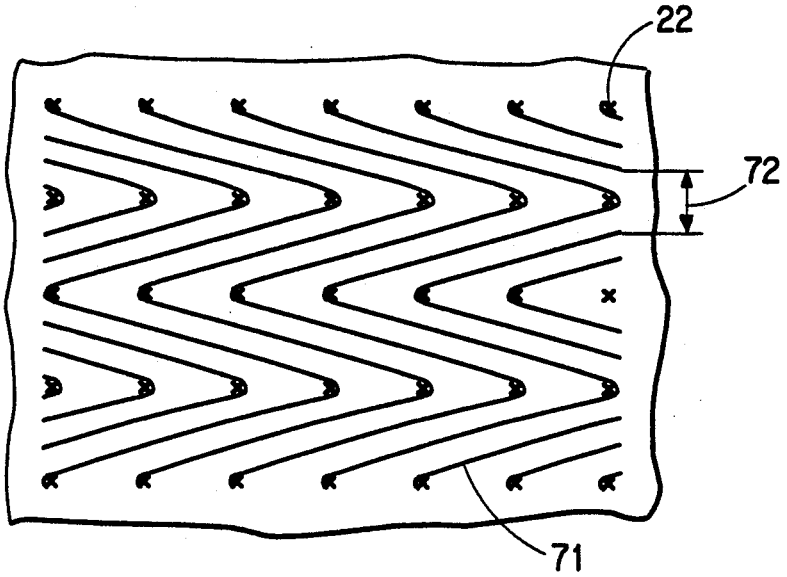
FIG. 6 illustrates a (0,0/4,4) laid-in stitch (A) and a (0,0/5,5) laid-in stitch (B), in accordance with the invention.
Figure 6B:
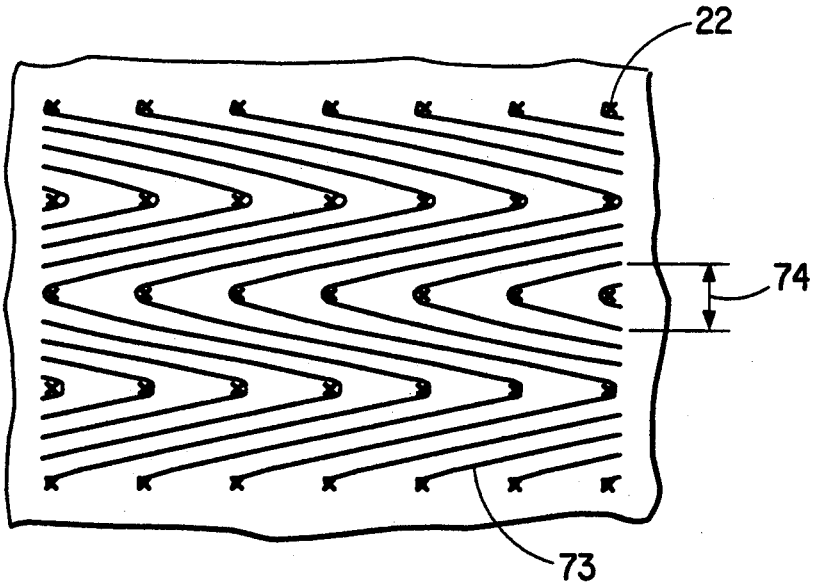

FIGS. 6A and B also depict "laid-in" stitched fabrics. FIG. 6A is a (0,0/4,4) stitch pattern wherein the minimum back fabric yarn 71 length is about 3.2 times the fabric length per stitch (all yarn on back). Assuming the technical back of the fabric is going to be the transport layer, critical length 72 is a maximum of 3 mm or the CPI is a minimum of 5.6. FIG. 6B is a (0.0/5.5) stitch pattern wherein the minimum back yarn 73 length is about 4.2 times the fabric length per stitch. Assuming the technical back of the fabric is going to be the transport layer, critical length 74 is a maximum of 3 mm or the CPI is a minimum of 4.2.

FIG. 7 depicts a combination of "laid-in" and "stitched-in" stitches. FIG. 7 represents the way FIG. 6A would look after the laid-in stitches had been anchored with a second stitched-in stitch set at (1,0/0,1). Yarn segments 81 in front and in back originate from chain stitches. Yarn segments 82 originate from tricot stitches. The critical length for the front of the fabric is 83 and for the back of the fabric the critical length is 84.

In order to join two web layers (absorbent/nonabsorbent) with stitches, bulkable yarns over 30 denier are also desirable. Depending upon the mechanical properties of the webs, a range of stitches can be used for this purpose. If the fabric contains at least one stable layer (e.g., a spunbonded polyester filament web as the nonabsorbent, "transport layer", combined with a spunlaced rayon-polyester absorbent, evaporation-reservoir layer) a simple chain-stitch should suffice. However, if the fabric needs added cross-stability, tricot, jersey or other stitches may be necessary.

A relatively dense nonabsorbent yarn layer on the outer, front technical face opposite from the inner, "transport layer" face will not affect the drying performance of the fabric. Actually, such an outer yarn layer could be desirable as a protective layer to resist abrasive wear. For instance, in Example 4 below, the "transport layer" is formed with a thin polypropylene web, the absorbent layer is formed of a rayon/polyester web, and the LycraR/nylon stitching yarn sections exposed on the protective, outer front technical face of the fabric act as an abrasion-resistant surface. The Lycra ®/nylon stitching yarn sections also tie the structure together and provide elasticity. It is to be noted that in this case, nylon is used as a protective yarn exposed to the outer surface, rather than as a moisture-transport yarn on the inner surface.

In the Examples which follow, measurements were made accordingly:

Fabric thickness is measured with the same apparatus as disclosed in U.S. Pat. No. 4,876,128, the contents of which are incorporated herein, using 10 gms of pressure on an area measuring 0.5 inch in diameter. Density and bulk values are calculated from the fabric thickness.

Absorbency is measured by gently placing a small piece of fabric 5 cm×5 cm flat on the open surface of 25° C. water contained in a laboratory tray (nonabsorbent layer facing against the water). All samples given below absorbed water and descended under the surface within 10–15 seconds. All except the sample of Example 4 also sank to the bottom of the tray. The wet sample was then carefully removed, allowed to drip for 1 minute, and placed on a horizontal non-absorbing surface (aluminum foil). Water pick-up was determined by weighing, and reported in gms of water absorbed per sq. m of fabric and in gms of water absorbed per gm of fabric.

The wet samples were allowed to dry at 40% relative humidity and 25° C. Water evaporation after 15 min and 1 hour was recorded. The retained water was measured every hour thereafter. The time required to come within 10 gm/sq. m of absorbed water is provided in Tables II and III below as the "drying time".

A final test, to determine the "dry feel" or "rewet" of the "transport layer" face vs. the "evaporation-reservoir" layer face, was performed in the following manner. The wet samples were placed between two identical dry paper towels and a 454 gm weight (bottom dimensions 3"×4") was placed on top for 15 seconds. The weight was removed and the water pick-up by the two towels was measured. Tables II and III show that the examples of this invention showed nearly zero "rewet" on the "transport layer" face. Conversely, the comparasion samples without a "transport layer", and those having nylon yarns on the "transport layer" face, had higher rewet values.

EXAMPLES

The invention will be further described by reference to the following non-limiting examples. All percentages are by weight unless indicated otherwise. In these examples, two fabrics of the invention, equipped with a moisture "transport layer" formed by yarn segments (Examples 1 and 2), are compared to (1) two commercially available knit fabrics used in comfort applications (Examples A and B); and (2) two stitched samples made according to the believed closest references (Examples C and D). Two more examples of the invention, where the transport layer is formed through the use of a nonabsorbent, nonwoven web stitchbonded to an absorbent, nonwoven web, are designated as Examples 3 and 4.

Tables II and III summarize fabric constructions and fabric evaluations. All basis weights are in gms per square meter. The "stitching" gauge or stitches per inch (GA) and courses per inch (CPI) are listed in English units. Stitch descriptions are given with the same notations as in Table I. The yarn and stitch utilized on each bar are listed separately. The stitching machine used was a 2-bar 150" wide Liba unit. Tables II and III assume that for "stitched-in" stitches an amount of yarn equal to two lengths of fabric per stitch was deployed on the front "technical face" of the fabric. The remainder of the yarn consumed (recorded on the machine) was assigned to the "technical back" of the fabric. Machine-recorded yarn consumptions were in close agreement to those predicted by Table I, which covers fabrics where the gauge and CPI were nearly equal (Examples C, D, 3 and 4). For examples where the CPI was much higher than the gauge (Examples 1 and 2), yarn consumption was, as predicted, substantially higher for the technical back of the fabric because of the high underlap density. In Tables II and III, total yarn weight per face, (marked "TOT") and total yarn-segment weight on the "transport" face (marked "TRANSP") are listed separately.

EXAMPLE 1

Figure 8:
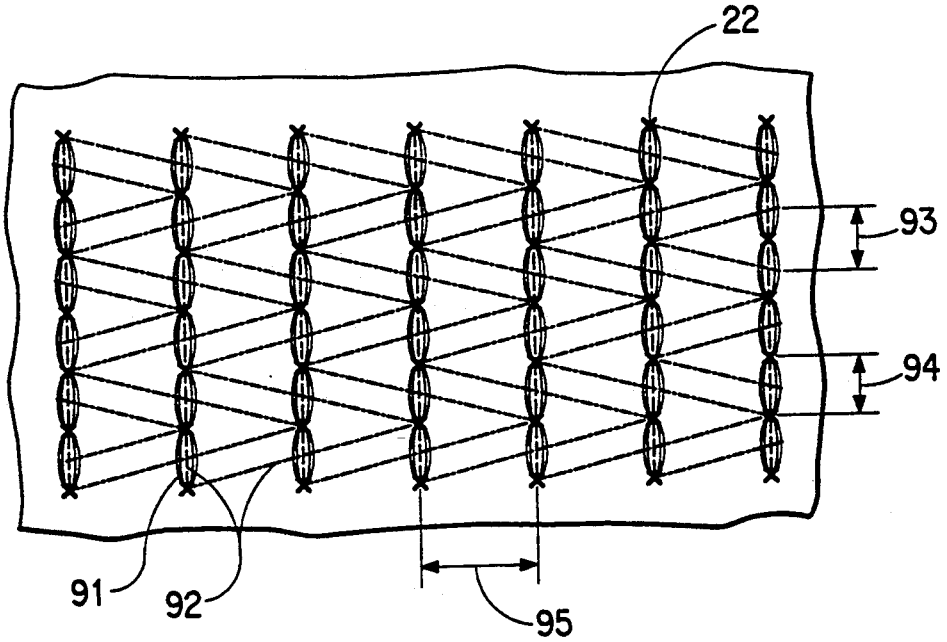
FIG. 8 illustrates a fabric in accordance with the invention wherein an absorbent web is used with a nonabsorbent, transport layer made up of a combination of jersey and pillar stitches.

Table II, FIG. 8

FIG. 8 depicts the stitch pattern used in Example 1. 1st yarn 91 is set at (0,1/1,0) to provide 3.6 g/sq m in front and 1.8 g/sq m in back. 2nd yarn 92 is set at (1,0/2,3) to provide 9.0 g/sq m on the back and 3.6 gm/sq m on the front, thus providing a total yarn weight of 12.6 g/sq m. Critical length 93 is 1.27 mm. Course 94 is 1/20 inch (1.27 mm) and wale 95 is 1/12 inch (2.1 mm). Spunlaced "SONTARA ®" Style 8411 (commercially available from E.I. du Pont de Nemours and Company, Wilmington, Delaware) was used as the absorbent, nonwoven web (70% rayon-30% polyester). Both yarns were 50 denier, 47 end (1.05 dpf) textured polyester yarn. The yarn weight forming the "transport layer" on the technical back face added up to 10.8 gm/sq. m, while total yarn in the greige fabric was 18.0 gm/sq. m. The fabric was finished on a pin-tenter with the machine and cross-direction dimensions held (zero overfeed, zero stretch) at 350° F. (177° C.), 3 ypm, and 1 minute dwell time. The fabric shrunk upon release of tension and increased in weight per unit area by approximately 10%. The fabric had high bulk and absorbency, very low rewet, and high and quick evaporation compared to the commercially available fabrics of Examples A, B, C and D set forth below. (Table III).

EXAMPLE A

Table III

In this example, a cotton knit fabric used in the gusset area of panties as an absorbent comfort insert was chosen as Example A. Table III shows that "A" is more than twice as heavy as Example 1 (which is intended for the same end-use), while it absorbs no more water than Example 1. Example 1 evaporates water much faster and dries 2-3 times faster. Also, Example 1 has a dramatic rewet advantage over cotton knit.

EXAMPLE B

Table III

In this example, a two-faced knit used in the gusset area of pantyhose was chosen as Example B. The less absorbent face is nylon and the highly absorbent face is cotton. In present day use, the nylon face is used outside as a protective layer. The fabric is much denser and heavier, with its basis weight out of the range of the present invention. This fabric absorbs less, and evaporates water much more slowly than Example 1. It also has substantial rewet values on both faces.

EXAMPLE C

Table III

In this example, a stitchbonded, absorbent sleeve fabric was made using textured nylon (70 denier, 34 filament) as the stitching yarn, and a lightly bonded, wetlaid sheet of 80 wt. % woodpulp and 20 wt. % 12 mm/1.5 dpf polyester as the absorbent component. This type of fabric is typically used as an absorbent sleeve for waste-fluid absorbing socks. The fabric forms a dense layer of nylon yarn segments on the technical back face amounting to a total of 21.6 gms/sq. m. The critical gap length in this case is $\frac{2}{3}\times 1/12\times 25.4$ mm or slightly over 2 mm (see FIG. 9). The fabric absorbs less and dries more slowly than Example 1 because of the presence of nylon and the excessive content of woodpulp. It also has a rewet value closer to the double-knit of Example B, much higher than the rewet value of Example 1.

EXAMPLE D

Table III

This fabric is a representation of Example 3-2 of the applicants' copending U.S. patent application Ser. No. 07/584,161, filed Sep. 18, 1990. The fabric employs a woodpulp/polyester spunlaced substrate (Style 8801 "SONTARA ®" commercially available from E. I. du Pont de Nemours and Company, Wilmington, Delaware) containing 60 wt. % woodpulp and 40 wt. % polyester. The stitching yarns were LycraR wrapped with nylon. An adequate "transport layer" density is formed on the technical back face (critical gap length in the greige fabric slightly over 1 mm), with a total nylon/Lycra ® weight of 17.3 gm/sq. m. This fabric increased to 163 gm/sq. m (out of claimed range of the invention) after being allowed to shrink due to the retractive power of the highly tensioned "inextensible" nylon-covered Lycra ® yarns. The fabric had low absorbency, high rewet, slow evaporation and very long drying times.

EXAMPLE 2

Figure 9:
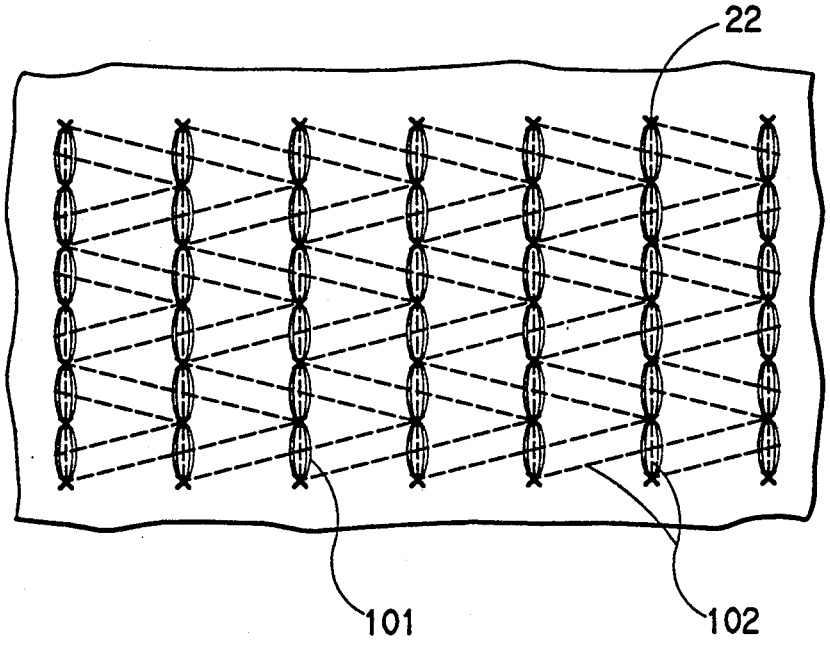
FIG. 9 illustrates the fabric of FIG. 8 with nylon yarns on the front face and back face to provide abrasive protection.

Table II, FIG. 9

FIG. 9 depicts the stitch pattern used in Example 2. 1st yarn 101 is applied using a (0,1/1,0) bar to provide 7.0+3.5=10.5 g/sq m yarns. 2nd yarn 102 is applied using a (1,0/2,3) bar to provide 5.8+10.9=16.7 g/sq m yarns. In this example, the same Style 8411 "SONTARA ®" absorbent web as employed in Example 1 was used. The "transport layer" was also formed on the "technical back" face of the fabric with the same polyester yarn segments as in Example 1. Additionally, the fabric utilized nylon yarns (with $\frac{2}{3}$ of the nylon on the technical front face and only $\frac{1}{3}$ on the technical back face), to provide abrasive protection to the front technical face and elastic shrinkage power for the fabric. The total nylon and polyester yarn weight on the technical back face was 10.9+3.5=14.4 gm/sq m. The fabric had very good absorbency and high evaporation rates, although it was slightly inferior to Example 1 in drying time and rewet value.

EXAMPLES 3 and 4

Table II

In these examples, a dual-layered web was used to the best advantage. Two samples (Examples 3 and 4) were made from lightweight, randomly-layed, consolidated (unbonded), continuous filament (1.5 denier) webs and used as the "transport layer". Example 3 was made of polyester (PET) and Example 4 was made of polypropylene. These transport layers also provide overall dimensional stability and eliminate the need for highly-densified cross-stitching. Nylon or Lycra ® wrapped with nylon were used for stitchbonding. The yarns used in these fabrics do not interfere with the rewet-barrier function (minimum yarn gap over 2 mm for Example 3 and over 4 mm for Example 4). Both fabrics had excellent absorbency, high drying speed and high rewet resistance. Both could be stretched to very low basis weights (28-30 gm/sq. m) without breaking, and could elastically recover back to basis weights as high as 56 gm/sq. m for Example 3, and 112 gm/sq. m for Example 4. These inventive fabrics represent excellent candidates for elastic or semi-elastic, ultra-low-weight, durable, comfort-wear or shirting uses.

TABLE II

| INVENTIVE EXAMPLE | 1 PANTY GUSSET | 2 PANTYHOSE GUSSET | 3 LOW-COST COMFORT GARMENT | 4 ELASTIC COMFORT GARMENT |
|---|---|---|---|---|
| WEB #1 | SONTARA 8411 | SONTARA 8411 | PET | POLYPROPYLENE |

TABLE II-continued

| INVENTIVE EXAMPLE | 1 PANTY GUSSET | 2 PANTYHOSE GUSSET | 3 LOW-COST COMFORT GARMENT | 4 ELASTIC COMFORT GARMENT |
|---|---|---|---|---|
| WT, GM/SQ M | 38 | 38 | 16 | 23 |
| WEB #2 | — | — | RAYON/PET CARDED | SONTARA 8411 |
| WT, GM/SQ M | — | — | 15 | 38 |
| 1st BAR | | | | |
| GAUGE/CPI | 12/20 | 14/10 | 12/12 | 12/12 |
| YARN/DEN | PET TEXT/50 | NYL TEXT/70 | NYL TEXT/40 | LYCRA/NYL 70-40 |
| COUNT/DPF | 47/1.04 | 34/2 | 13/3.1 | 13/1.7 |
| STITCH | 0.1/1.0 | 0.1/1.0 | 1.0/2.3 | 1.0/1.2 |
| FRONT WT (TOT/TRANS) | 3.6/0 | 7.0/0 | 3.2/3.2 | 5.3/5.3 |
| BACK WT (TOT/TRANS) | 1.8/1.8 | 3.5/3.5 | 2.2/0 | 4.4/0 |
| TOTAL YN (TOT/TRANS) | 5.4/1.8 | 10.5/3.5 | 5.4/3.2 | 9.7/5.3 |
| 2nd BAR | | | | |
| GAUGE, CPI | 12/20 | 14/20 | — | — |
| YARN/DEN | PET TEXT/50 | PET TEXT/50 | — | — |
| COUNT/DPF | 47/1.04 | 47/1.05 | — | — |
| STITCH | 1.0/2.3 | 1.0/2.3 | — | — |
| FRONT WT (TOT/TRANS) | 3.6/0 | 5.8/0 | — | — |
| BACK WT (TOT/TRANS) | 9.0/9.0 | 10.9/10.9 | — | — |
| TOTAL YARN (TOT/TRANS) | 12.6/9.0 | 16.7/10.9 | — | — |
| FABRIC | | | | |
| TRANSPORT FACE | BACK | BACK | FRONT | FRONT |
| WT (GREIGE/ FINISHED) | 58/68 | 66/91 | 46/56(28) | 79/112(30) |
| ABSORBENCY, | | | | |
| GM/SQ. M, | 482 | 601 | 576 | 672 |
| TIMES WT | 7.1 | 6.6 | 10.3 | 6.0 |
| BULK CC/GM | 11.9 | 10.9 | 16.7 | 10.1 |
| EVAPORATION, GM/SQ. M | | | | |
| 15 MIN | 64 | 68 | 78 | 83 |
| 1 HR | 187 | 210 | 378 | 280 |
| DRYING TIMES HOURS | 4 | 5 | 2 | 4 |
| REWET, GMS (TR/AB) | 121/5 | 81/8 | 71/2 | 79/2 |

TABLE III

| COMPARATIVE EXAMPLE | A COTTON GUSSET | B PANTYHOSE GUSSET | C SLEEVE FABRIC | D COPENDING USSN 07/584,161 EX 3-2 |
|---|---|---|---|---|
| WEB #1 | — | — | 80/20 PAPER | SONTARA 8801 |
| WT, GM/SQ M | — | — | 43 | 75 |
| WEB #2 | — | — | — | — |
| WT, GM/SQ M | — | — | — | — |
| 1st BAR | | | | |
| GAUGE/CPI | — | — | 12/12 | 14/11.5 |
| YARN/DEN | — | — | NYL/TEXT 70 | NYL/TEXT 40 |
| COUNT/DPF | — | — | 34.2 | 34/2.7 |
| STITCH | — | — | 0.1/1.0 | 0.1/1.0 |
| FRONT WT (TOT/TRANS) | — | — | 7.0/0 | 4.0/0 |
| BACK WT (TOT/TRANS) | — | — | 3.5/3.5 | 2.5/2.5 |
| TOTAL YN (TOT/TRANS) | — | — | 10.5/3.5 | 6.5/2.5 |
| 2nd BAR | | | | |
| GAUGE, CPI | — | — | 12/12 | 14/11.5 |
| YARN/DEN | — | — | NYL TEXT/70 | LYCRA/NYL |
| COUNT/DPF | — | — | 34/2 | — |
| STITCH | — | — | 1.0/3.4 | 1.0/4.5 |
| FRONT WT (TOT/TRANS) | — | — | 7.0/0 | 5.0/0 |
| BACK WT (TOT/TRANS) | — | — | 18.8/18.1 | 14.8/14.8 |
| TOTAL YARN (TOT/TRANS) | — | — | 25.1/18.1 | 19.8/14.8 |
| FABRIC | | | | |

TABLE III-continued

| COMPARATIVE EXAMPLE | A COTTON GUSSET | B PANTYHOSE GUSSET | C SLEEVE FABRIC | D COPENDING USSN 07/584,161 EX 3-2 |
|---|---|---|---|---|
| TRANSPORT FACE | — | NYLON | BACK | BACK |
| WT (GREIGE/ FINISHED) | 153 | 144 | 78/121 | 81/163 |
| ABSORBENCY, | | | | |
| GM/SQ. M, | 513 | 446 | 375 | 635 |
| TIMES WT | 3.8 | 3.1 | 3.1 | 3.9 |
| BULK CC/GM | 2.9 | 2.2 | 4.8 | 5.0 |
| EVAPORATION, GM/SQ. M | | | | |
| 15 MIN | 29 | 31 | 13 | 16 |
| 1 HR | 48 | 112 | 42 | 48 |
| DRYING TIMES HOURS | 9 | 12 | 16 | 29 |
| REWET, GMS (TR/AB) | 32/26 | 76/38 | 90/42 | 70/16 |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A durable, nonwoven comfort fabric having a basis weight of from 20 to 120 grams per square meter, the fabric comprising:

(a) an absorbent, evaporation-reservoir layer formed from a nonwoven web that is stitched through with at least one bulkable stitching yarn that forms spaced-apart rows of stitches extending along the length of the web; and (b) a nonabsorbent, transport layer weighing at least 10 grams per square meter and formed from a network of stitching yarns which are not significantly water absorbent and which are stitched through the web, the network exhibiting stitching gaps no wider than 3 millimeters, wherein the resulting dual-layered, stitchbonded fabric has a bulk of at least 10 cubic centimeters per gram and is capable of absorbing at least 5 times its weight in water.

2. The comfort fabric of claim 1 having a basis weight of 20 to 80 grams per square meter.

3. The comfort fabric of claim 1 wherein the network of stitching yarns is formed by a stitching pattern selected from the group consisting of chain stitches, pillar stitches, atlas stitches, tricot stitches, jersey stitches, satin stitches and long-float stitches.

4. The comfort fabric of claim 1 wherein there is at least one bulkable yarn stitch every 1.5 millimeters.

5. The comfort fabric of claim 1 wherein the stitching yarns of the nonabsorbent, transport layer have deniers of from 30 to 150.

6. The comfort fabric of claim 1 wherein the yarns of the nonabsorbent, transport layer are selected from the group consisting of textured polyesters, textured polypropylene and textured polyethylene.

7. The comfort fabric of claim 1 wherein the nonwoven web of the absorbent layer comprises a web selected from the group consisting of rayon, cotton, cotton/polyester blends, cotton/polypropylene blends, rayon/polyester blends and woodpulp/polyester blends.

8. A garment constructed from the comfort fabric of claim 1.

9. A durable, nonwoven comfort fabric comprising:

(a) an absorbent, evaporation-reservoir layer formed from an absorbent, nonwoven web; and (b) a nonabsorbent, transport layer weighing at least 10 grams per square meter and formed from a nonwoven, fibrous web which does not significantly absorb water, wherein the webs are stitched together with at least one bulkable stitching yarn that forms spaced-apart rows of stitches extending along the length of the absorbent, nonwoven web to form a dual-layered fabric having a bulk of at least 10 cubic centimeters per gram and capable of absorbing at least 5 times its weight in water.

10. The comfort fabric of claim 9 wherein the fibrous web of the nonabsorbent, transport layer comprises spunlaced continuous filaments selected from the group consisting of polyester, polyethylene and polypropylene.

11. The comfort fabric of claim 9 wherein the fabric has a basis weight of between 20 to 120 grams per square meter.

12. The comfort fabric of claim 9 wherein there is at least one bulkable yarn stitch every 1.5 millimeters.

13. The comfort fabric of claim 9 wherein the stitching yarns of the nonabsorbent, transport layer have deniers of from 30 to 150.

14. The comfort fabric of claim 9 wherein the nonwoven web of the absorbent layer comprises a high bulked web selected from the group consisting of rayon, cotton, cotton/polyester blends, cotton/polypropylene blends, rayon/polyester blends and woodpulp/polyester blends.

15. A garment constructed from the comfort fabric of claim 9.

* * * * *